United States Patent [19]

Isaacs et al.

[11] Patent Number: 4,560,360

[45] Date of Patent: Dec. 24, 1985

[54] INFLATABLE ASSEMBLY WITH EDGE CLOSURE

[76] Inventors: Michael S. Isaacs, 175 Falmouth St.; Richard Blacksberg, 182 Amherst St., both of Brooklyn, N.Y. 11235

[21] Appl. No.: 505,995

[22] Filed: Jun. 20, 1983

[51] Int. Cl.[4] ..... A63H 3/06

[52] U.S. Cl. ..... 446/222

[58] Field of Search ..... 46/87, 90; 244/24; 152/367; 248/205 A; 156/289; 446/220, 222, 224, 225, 226

[56] References Cited

U.S. PATENT DOCUMENTS

| | | | |
|---|---|---|---|
| 2,396,906 | 3/1946 | Windson | 46/90 |
| 2,674,064 | 4/1954 | Gassaway | 46/90 |
| 3,088,242 | 5/1963 | Rockovits | 46/90 |
| 3,108,396 | 10/1963 | Dorman | 46/90 |
| 3,230,663 | 1/1966 | Shabram | 46/90 |
| 3,837,608 | 9/1974 | Simon | 248/205 A |
| 4,197,151 | 4/1980 | Muzik | 156/289 |
| 4,516,949 | 5/1985 | Schwartz | 446/222 |

*Primary Examiner*—Robert A. Hafer
*Assistant Examiner*—Daniel Nolan
*Attorney, Agent, or Firm*—Lilling & Greenspan

[57] ABSTRACT

An inflatable assembly formed of two superimposed sheets sealed at the peripheries thereof to form a generally closed gas receiving compartment including opposing sheet portions having generally aligned initially unsealed edges which form an opening for receiving a gas conduit during inflation. Adhesive or a double-sided adhesive strip is provided on one of the sheet portions facing the other sheet portion. Premature adhesion between the sheet portion is prevented by a removable protective strip disposed between the adhesive surface and the facing sheet portion. After inflation and removal of the gas conduit and the protective strip, application of pressure to the sheet portions seals the opening to prevent escape of gas therethrough.

11 Claims, 6 Drawing Figures

FIG. 1
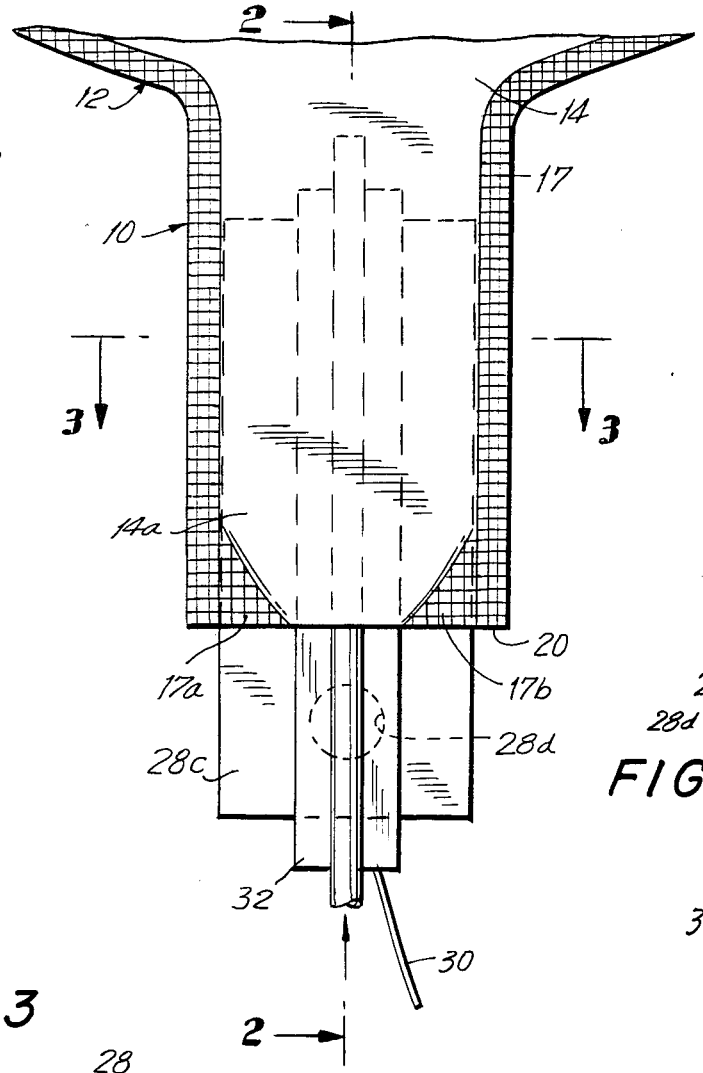
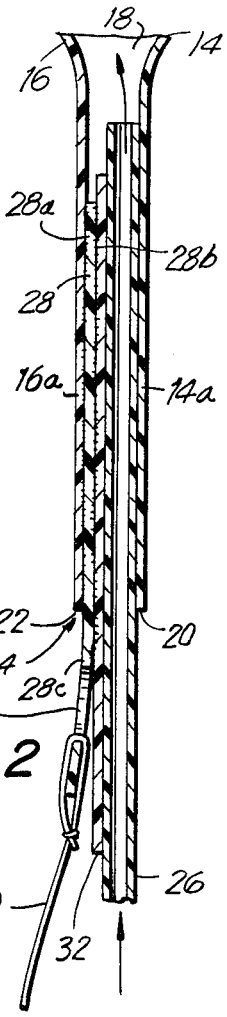
FIG. 2
FIG. 3
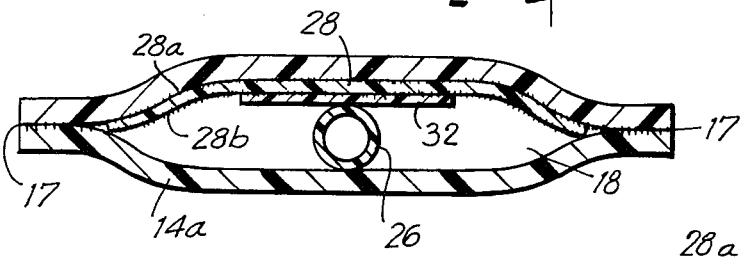
FIG. 4
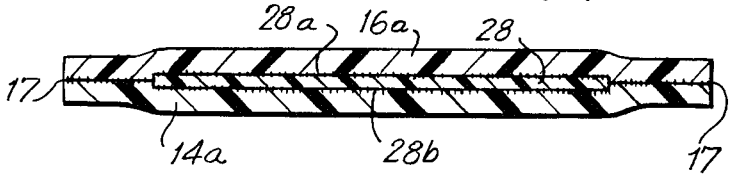
FIG. 5
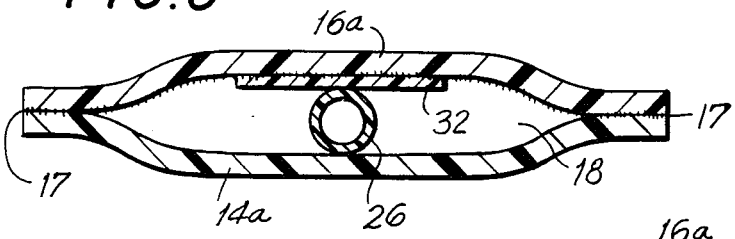
FIG. 6
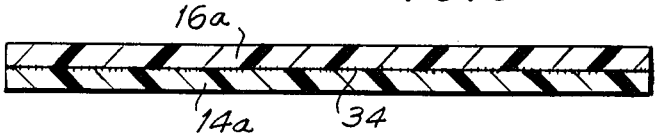

INFLATABLE ASSEMBLY WITH EDGE CLOSURE

BACKGROUND OF THE INVENTION

Toy inflatable balloons have traditionally been made of rubber. Balloons made of Mylar and other sheet materials, usually metalized, have been introduced which are less pervious to gas losses and can retain helium, for example, for several days. Sealing the openings through which the ballons are inflated has, however, presented a problem.

One attempt at sealing balloons of sheet material has been to twist the ends or neck portions thereof following inflation and tying the twisted ends with a string. This approach has not, however, proved satisfactory since excessive losses of gas have taken place through the twisted and tied ends.

Spring clips have also been used in an effort to seal off the open ends of foil-type balloons. These clips are typically applied to the twisted ends of the balloons to pinch or squeeze the twisted ends thereby to halt escape of gas. However, irrespective of the biasing forces applied to the twisted ends by the spring clips, minute channels have remained through which gases can gradually escape.

A number of plugs have been proposed for sealing the openings through which film balloons are inflated. Some of these plugs are generally tapered and are intended to be simply forced into suitable valve openings following inflation. Reliance on force fits, however, have not proved satisfactory because of the difficulty of manufacturing processes in providing sufficiently close tolerances. Other plugs have been more elaborate. In all cases, however, such plugs have tended to be too complex, too expensive and too heavy to be practical.

Another approach has been to heat seal the open ends subsequent to inflation. While such sealing has reduced the amount of gas leakage, it has been inconvenient to use and has required heat sealing equipment which must be connected to power lines thereby reducing its mobility. Also, the heat seals produced have not been consistently satisfactory, particulary when made by inexperienced operators.

SUMMARY OF THE INVENTION

Accordingly, it is an object of the invention to provide an inflatable assembly which eliminates the disadvantages inherent in the existing assemblies.

It is another object of the present invention to provide an inflatable assembly which has a closure which is simple in construction and economical to manufacture.

It is still another object of the present invention to provide an inflatable assembly which can be sealed with minimal dexterity and loss of gas.

It is yet another object of the present invention to provide an inflatable assembly having a closure which is reliable and which minimizes gas leakages.

Other objects and advantages of the present invention will become apparent from the disclosure that follows.

In accordance with the invention, an inflatable assembly comprises a device formed of sheet material defining a generally closed gas receiving compartment including opposing sheet portions having generally aligned unsealed edges which define an opening to said compartment dimensioned to receive a conduit associated with a source of gas. Adhesive means are provided on a surface of one of said sheet portions facing the other of said sheet portions. Separator means is disposed between said adhesive means and said other offset sheet portions to prevent premature attachment of said sheet portions to each other and being adapted to be removed, thereby exposing said adhesive means to said other offset portions. In this manner, removal of said separator means subsequent to inflation of said inflatable device and application of pressure to said sheet portions seals said opening to prevent escape of gas therethrough.

BRIEF DESCRIPTION OF THE DRAWINGS

A better understanding of the present invention may be had from a consideration of the following detailed description taken in conjunction with the accompanying drawings, in which:

FIG. 1 is a fragmented section of an inflatable assembly, showing the part thereof which includes the sealing valve or assembly in accordance with the present invention;

FIG. 2 is a cross-sectional view of the assembly and closure valve shown in FIG. 1, taken along line 2—2;

FIG. 3 is a cross-sectional view of the assembly and closure valve shown in FIG. 1, taken along line 3—3;

FIG. 4 is similar to FIG. 3, but showing the manner in which the inflatable assembly is sealed subsequent to inflation;

FIG. 5 is similar to FIG. 3, but showing an alternate embodiment of the invention; and FIG. 6 is similar to FIG. 4, but showing the manner in which the inflatable assembly FIG. 5 is sealed subsequent to inflation.

DETAILED DESCRIPTION OF THE PREFERRED EMBODIMENTS

Referring now specifically to the figures, in which identical or similar parts have been designated by the same reference numerals throughout and first referring to FIG. 1, the inflatable assembly in accordance with the invention is generally designated by the reference numeral 10.

Referring to FIGS. 1 and 2, the inflatable assembly 10 includes a device 12 formed of sheet material, and specifically a front or top sheet 14 and a back or rear sheet 16. The device 12 may have a main body portion and a neck portion typical of most inflatable toy balloons. It is sufficient to illustrate the neck of the balloon for purposes of illustrating the present invention since it is in that portion of the balloon that the closure mechanism is normally provided. Any other placement of the closure is possible.

The top and rear sheets 14 and 16 may be made of any suitable material typically used in the manufacture of balloons. In the presently preferred embodiment described the sheets 14, 16 may be made of foil, metalized fabric or nylon, vinyl or sheet materials, polymers, polypropylene, etc.

The sheets 14, 16 are similarly shaped and superimposed so that they can be sealed at 17 with heat or in any other conventional means. The seal 17 extends substantially about the entire periphery of the front and rear sheets 14, 16 to form a generally closed gas receiving compartment 18. Opposing sheet portions **14*a* and 16*a*, which form the neck of the device 12, have generally aligned initially unsealed edges 20, 22 which define an opening 24 to the gas compartment 18 dimensioned to receive an external and reusable conduit or tube 26** associated with a source of gas.

Adhesive means is provided which includes an adhesive strip 28 provided with adhesive 28*a*, 28*b* on the two sides thereof and being attached at one of the sides to the rear sheet 16 by means of the adhesive 28*a*. A protective or separator strip in the nature of slip paper 32 is disposed betwen the adhesive surface 28*b* on the adhesive strip 28 and the sheet portion 14*a* to prevent premature attachment of the sheet portions 14*a*, 16*a* to each other and is adapted to be resistent to adhesion to the surface adhesive 28*b* thereby being removable to effect sealing. In this manner, removal of the slip paper 32 subsequent to inflation of the inflatable device 12 and application of pressure to the sheet portions 14*a*, 16*a* seals the opening 24 to prevent escape of gas therethrough.

In the presently preferred embodiment shown in FIGS. 1 and 2, the adhesive strip 28 preferably and optionally extends beyond the opening 24 to provide a non-adhesive tab or extension 28*c* to which a string can be attached. In this connection, the extension or tab is advantageously provided with a hole 28*d* to facilitate attachment of the string or ribbon 30.

Referring to FIG. 1, the seal 17 is shown extending about the periphery of the device 12 and extending up to the edges 20, 22. Preferably, the seals are enlarged in the region in the opening 24 such as by providing additional sealing area 17*a*, 17*b*, shown in FIG. 1, to effectively reduce the size of opening 24 to a width less than the width of the sheet portions 14*a*, 16*a*.

Referring to FIGS. 1-3, it would be evident that insertion of the inflated tube or conduit 26 through the opening 24, while positioned between the sheet portion 14*a* and the protective or seperator strip 32, allows the inflatable device 12 to be inflated while preventing premature attachment of the sheet portions 14*a*, 16*a* to each other.

Once the device has been inflated, removal of the strip 32 and the inflator tube 26 exposes the adhesive surface 28*b* to the sheet portion 14*a* whereby application of pressure to the sheet portions 14*a*, 16*a* seals the opening 24 to prevent escape of gas therethrough. FIGS. 3 and 4, respectively, illustrate the arrangement of the above discussed elements in the neck portion of the device during and subsequent to inflation at which time sealing is effected.

Referring to FIGS. 5 and 6, an alternate embodiment is illustrated which in every respect operates in the same way as described above in connection with FIGS. 1–4. However, instead of using a separate strip 28 provided with adhesive 28*a*, 28*b* on the two surfaces thereof, adhesive 34 is applied directly to the inner surface of the sheet portion 16*a*. Here, premature attachment of the sheet portions 14*a*, 16*a* is avoided by the use of the protective or separator strip 32. Inflation takes place in the same manner by inserting the inflator tube 26. Once inflation has been achieved, the inflator tube or conduit 26 and the protective or separator strip 32 are withdrawn to thereby make it possible to sealingly join the sheet portion 14*a*, 16*a* by simple application of finger pressure thereto.

The protective or separator strip 32, in both cases, is selected to be resistent to the adhesive surfaces 28*b* or the adhesive 34. Such a strip may be made of any material which is surface treated with an adhesive-resistent material such as silicone.

Although there has been described a presently preferred embodiment in accordance with the invention for the purposes of illustrating the manner in which the invention may be used, it will be appreciated that the invention is not limited thereto. Accordingly, any and all modifications, variations or equivalent arrangements which come within the scope of the appended claims should be considered to be a part of the invention.

Thus, materials used to manufacture balloons have a wide range of thicknesses. Extremely thin materials may wrinkle and produce creases and undesirable passageways which will act as conduits allowing slow leakage of the gas introduced into the balloon. With such thin materials, it may be necessary to affix a reinforcing section of thicker, more rigid material between the front sheet 12 of the neck portion 18 and the strip 28, which is also provided with an aperture which registers or is aligned with the aperture 28. Advantageously, the reinforcing section is larger than the strip 28 so that it serves as an effective flat, rigid base for the strip 28 to thereby assure optimum sealing.

What is claimed is:

1. An inflatable assembly comprising:

a. A device formed of sheet material defining a generally closed gas-receiving compartment including opposing sheet portion having generally aligned initially unsealed edges which define an opening to said compartment;

b. an external and reusable conduit adapted to be associated with a source of gas, said conduit being inserted into said opening prior to inflation;

c. adhesive means provided on a surface of at least one of said sheet portions facing the other of said sheet portions; and d. separator means disposed between said adhesive means and said other of said sheet portions and defining, with said other sheet portion, a passage for said external and reusable conduit, said separator means being provided with a slip surface on at least one surface thereof facing said adhesive means which does not adhere to said adhesive means and can slideably move relative to said adhesive means when in abutment therewith to prevent premature attachment of said sheet portions to each other and being adapted to be removed thereby exposing said adhesive means to said other of said sheet portions, whereby removal of said separator means and said external and reusable conduit subsequent to inflation of said inflatable device and application of pressure to said sheet portions seals said opening to prevent escape of gas therethrough.

2. An inflatable assembly as defined in claim 1, wherein said device comprises superimposed front and rear sheets of materials sealed about the peripheries thereof with the exception of said initially unsealed edges.

3. An inflatable assembly as defined in claim 2, wherein said sheets of material each include a main body portion and a neck portion.

4. An inflatable assembly as defined in claim 1, wherein said adhesive means comprises an adhesive strip provided with adhesive on both sides thereof and being atached at one of said sides to one of said sheet portions, said separator means being disposed between the adhesive on the other side of strip and the other of said sheet portions.

5. An inflatable assembly as defined in claim 4, wherein said adhesive strip extends beyond said opening to provide a tab to which a string can be attached.

6. An inflatable assembly as defined in claim 5, wherein said tab is provided with a hole to facilitate attachment of a string.

7. An inflatable assembly as defined in claim 1, wherein said sheet portions have a predetermined width, and sealing means for sealing the peripheries said sheet portions with the exception of said opening.

8. An inflatable assembly as defined in claim 7, wherein said sealing means seals at least portions of said unsealed edges to provide an opening having a width less than said predetermined width.

9. An inflatable assembly as defined in claim 8, wherein said separator means has a width substantially equal to the width of said opening.

10. An inflatable assembly as defined in claim 4, wherein said adhesive strip has a width substantially equal to the width of said sheet portions.

11. An inflatable assembly as defined in claim 1, wherein said adhesive means comprises adhesive.

* * * * *